US007448154B1

(12) United States Patent
Kludt

(10) Patent No.: US 7,448,154 B1
(45) Date of Patent: Nov. 11, 2008

(54) SIGN SYSTEM

(75) Inventor: Kory D. Kludt, Brookings, SD (US)

(73) Assignee: Daktronics, Inc., Brookings, SD (US)

( * ) Notice: Subject to any disclaimer, the term of this patent is extended or adjusted under 35 U.S.C. 154(b) by 660 days.

(21) Appl. No.: 11/148,461

(22) Filed: Jun. 9, 2005

(51) Int. Cl.

| | |
|---|---|
| ***G09F 9/37*** | (2006.01) |
| ***G09F 13/04*** | (2006.01) |
| ***G09F 7/00*** | (2006.01) |
| ***A47G 1/06*** | (2006.01) |
| ***E04B 1/00*** | (2006.01) |
| ***E04C 2/38*** | (2006.01) |

(52) U.S. Cl. ..... 40/446; 40/793; 40/611.02; 40/790; 40/574; 40/578; 52/58; 52/272; 52/475.1; 52/483.1; 52/762; 52/775; 52/780; 52/716

(58) Field of Classification Search ..... 40/446, 40/793, 611.02, 790, 574, 578; 52/58, 272, 52/475.1, 483.1, 762, 775, 780, 716
See application file for complete search history.

(56) References Cited

U.S. PATENT DOCUMENTS 3,310,901 A * 3/1967 Sarkisian ..... 40/793

* cited by examiner

*Primary Examiner*—Lesley D. Morris
*Assistant Examiner*—Syed A Islam
(74) *Attorney, Agent, or Firm*—Hugh D. Jaeger

(57) ABSTRACT

A sign system having components promoting ease of construction and readily accomplished changeout. Unique geometrically configured top and bottom support channels and other related components readily accommodate and capture the top and bottom edges of electronic display panels. Top and bottom shrouds attach automatically to the unique geometrically configured top and bottom support channels and include weatherstrip seals which automatically seal against the upper and lower regions of the electronic display panels. Other automatic seals are also incorporated.

1 Claim, 17 Drawing Sheets

SIGN SYSTEM

CROSS REFERENCES TO RELATED APPLICATIONS

None.

BACKGROUND OF THE INVENTION

1. Field of the Invention

The present invention is for a sign system, and, more particularly, pertains to an electronic sign system having features which promote ease of construction and readily accomplished changeout.

2. Description of the Prior Art

Prior art sign systems, while well constructed, involved multiple and detailed construction steps, especially when installing the electronic display panels in the framework of sign cabinetry. Some electronic display panels require individual rectangular mounting surfaces for mounting along all edges where each edge of the electronic display panels is secured to an accommodating portion of the framework using multiple fasteners and sealing devices. Such an arrangement is labor intensive, thus adding to production time and cost. Some electronic sign systems were constructed wherein the electronic display panels were removable only from the inside or the outside of the cabinetry but not both. Some sign systems are difficult to seal against the elements and involve minimal protection against the entry of water, gases, insects and the like. Some sign systems are of large stature, such as large overhead freeway sign systems or other large sign systems, and are located in difficult to access locations where access is only provided at the front of the sign system by the use of a catwalk, thereby adding materials and labor to the cost. Clearly what is needed is an electronic sign system which overcomes the undesirable properties of the prior art.

SUMMARY OF THE INVENTION

The general purpose of the present invention is to provide a sign system. The sign system is of economically feasible construction and offers rapid and easy replacement of components, such as one or more electronic display panels. A support framework using a plurality of substantially vertically and horizontally aligned channels and support angles includes unique geometrically configured top and bottom support channels, many features of both being elongated and utilized to readily and securingly accommodate a plurality of juxtaposed electronic display panels and other unique components.

The horizontally aligned bottom support channel, which is unique and geometrically configured, and the horizontally aligned top support channel, which is unique and geometrically configured, oppose each other at the front of the sign system. Each of the top and bottom support channels has structure and features which are generally elongated, and each is utilized in conjunction with unique retainer bars, each configured as a channel, for rapidly facilitated mounting of the electronic display panels. The bottom support channel includes a pivot bar extending along a top panel for engagement and pivotal accommodation and captured support of notched features at the bottom of the edges of one or more electronic display panels. Each electronic display panel rests on and is pivoted about the pivot bar during installation to cause the top of each electronic display panel to engage a horizontally aligned seal in the form of a weatherstrip seal at the inside lower portion of the top support channel front panel. The tops of the electronic display panels are subsequently and forcibly secured against the weatherstrip seal by use of individual retainer bars which are capturingly secured between the upper regions of the electronic display panels and an arcuate receptor at an edge of a bottom panel of the top support channel.

Each electronic display panel includes a vertically aligned weatherstrip seal on one or more vertically aligned edges to mutually seal the edges of adjacent electronic display panels or to seal between an outer edge of an outer electronic display panel and an edge panel of an adjacent face plate. Additional sealing capability is offered by a plurality of top shrouds, generally being elongated, each including an arcuate receptor at and extending along a connecting panel and a horizontally oriented weatherstrip seal extending along an arcuate panel at the lower edge. The arcuate receptor, which is also generally elongated and which extends along the top edge of each top shroud, engages and is positioned about an arcuate lip which is also elongated and which extends along the junction of the front panel and the top panel of the top support channel. The arcuate receptor of each top shroud is positioned about the arcuate lip to aid in positioning the weatherstrip seal against an upper region of an electronic display panel to form a second horizontally oriented weatherstrip seal. Elongated catch panels extending along the front panel of each top shroud extend inwardly to frictionally engage outwardly extending elongated catch panels extending along the front panel of the top support channel to maintain the closely juxtaposed relationship of the top shrouds with the top support channel and the electronic display panels. A plurality of bottom shrouds of similar shape and function to the top shrouds are provided for use at the junctions of the lower regions of the electronic display panels and the bottom support channel.

According to one or more embodiments of the present invention, there is provided a sign system including a framework for support including unique geometrically configured top and bottom support channels which are elongated and connected to other framework components, a plurality of juxtaposed electronic display panels where each electronic display panel rests on a pivot bar on the top panel of the unique geometrically configured bottom support channel and where the top regions of each electronic display panel engage a weatherstrip seal at the front panel of the top support channel and are positionally secured thereagainst by a retainer bar, a plurality of weatherstrip seals located in vertical orientation along one or more edges of the electronic display panels, a plurality of top shrouds each being elongated and having an arcuate receptor extending along a connecting panel which engages an arcuate lip extending along the top support channel and having a weatherstrip seal located along an arcuate panel for contacting the upper region of electronic display panels, a plurality of bottom shrouds each being elongated and having an arcuate receptor extending along a connecting panel which engages an arcuate lip extending along the bottom support channel and having a weatherstrip seal located along an arcuate panel thereof for contacting the lower regions of the electronic display panels, and inwardly extending elongated catch panels extending along the front panels of each of the top and bottom shrouds which engage outwardly extending elongated catch panels extending along the front panels of the top and bottom support channels, respectively, to maintain the relationship of each top shroud with the top support channel and the electronic display panels and each bottom shroud with the bottom support channel and the electronic display panels.

One significant aspect and feature of the present invention is a sign system having features which promote rapid installation or replacement of electronic display panels.

Another significant aspect and feature of the present invention is a sign system incorporating a minimum number of components and a minimum number of mechanical steps associated with rapid installation or replacement of electronic display panels.

Still another significant aspect and feature of the present invention is the use of a bottom support channel and a top support channel for support of the lower and upper regions of electronic display panels.

Yet another significant aspect and feature of the present invention is the use of a pivot bar on a bottom support channel for pivotal engagement and for captured support of the lower region of an electronic display panel.

A further significant aspect and feature of the present invention is the use of a retainer bar associated with a top support channel for captured support of the upper region of an electronic display panel.

Another significant aspect and feature of the present invention is the use of top and bottom shrouds which attach automatically to the top support channel and the bottom support channel of a sign system.

Another significant aspect and feature of the present invention is the use of top and bottom shrouds having weatherstrip seals which seal automatically against the upper and lower regions of electronic display panels.

Another significant aspect and feature of the present invention is the use of weatherstrip seals between adjacent electronic display panels or between an electronic display panel and a face plate.

Another significant aspect and feature of the present invention is the use of snap engagement shrouding which eliminates any external hardware from communicating with or entering the interior of the enclosure cabinet, thereby creating a watertight sign system.

Having thus briefly described an embodiment of the present invention and having mentioned some significant aspects and features of the present invention, it is the principal object of the present invention to provide a sign system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
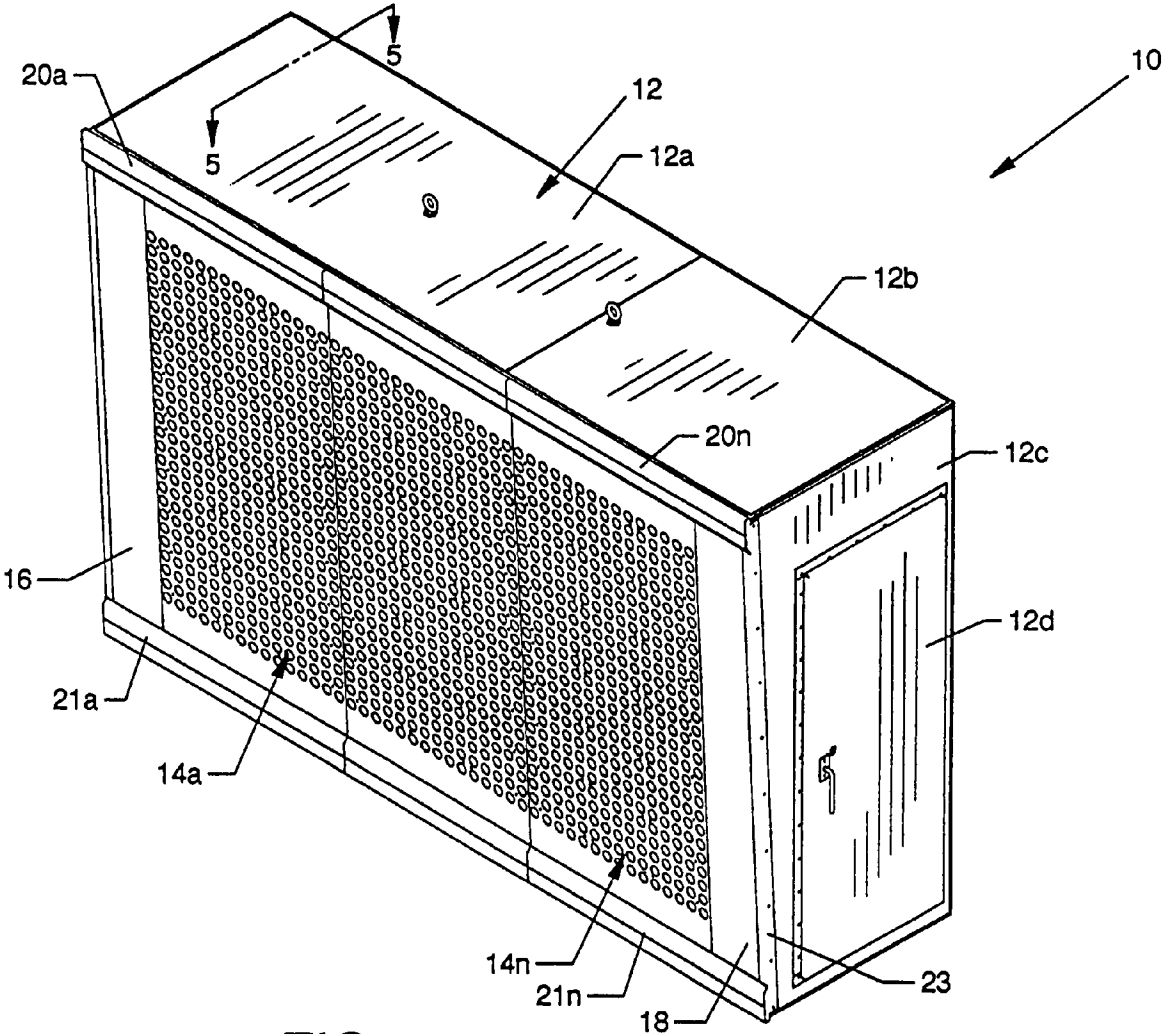
FIG. 1 is an isometric view of a sign system, the present invention.
Figure 2:
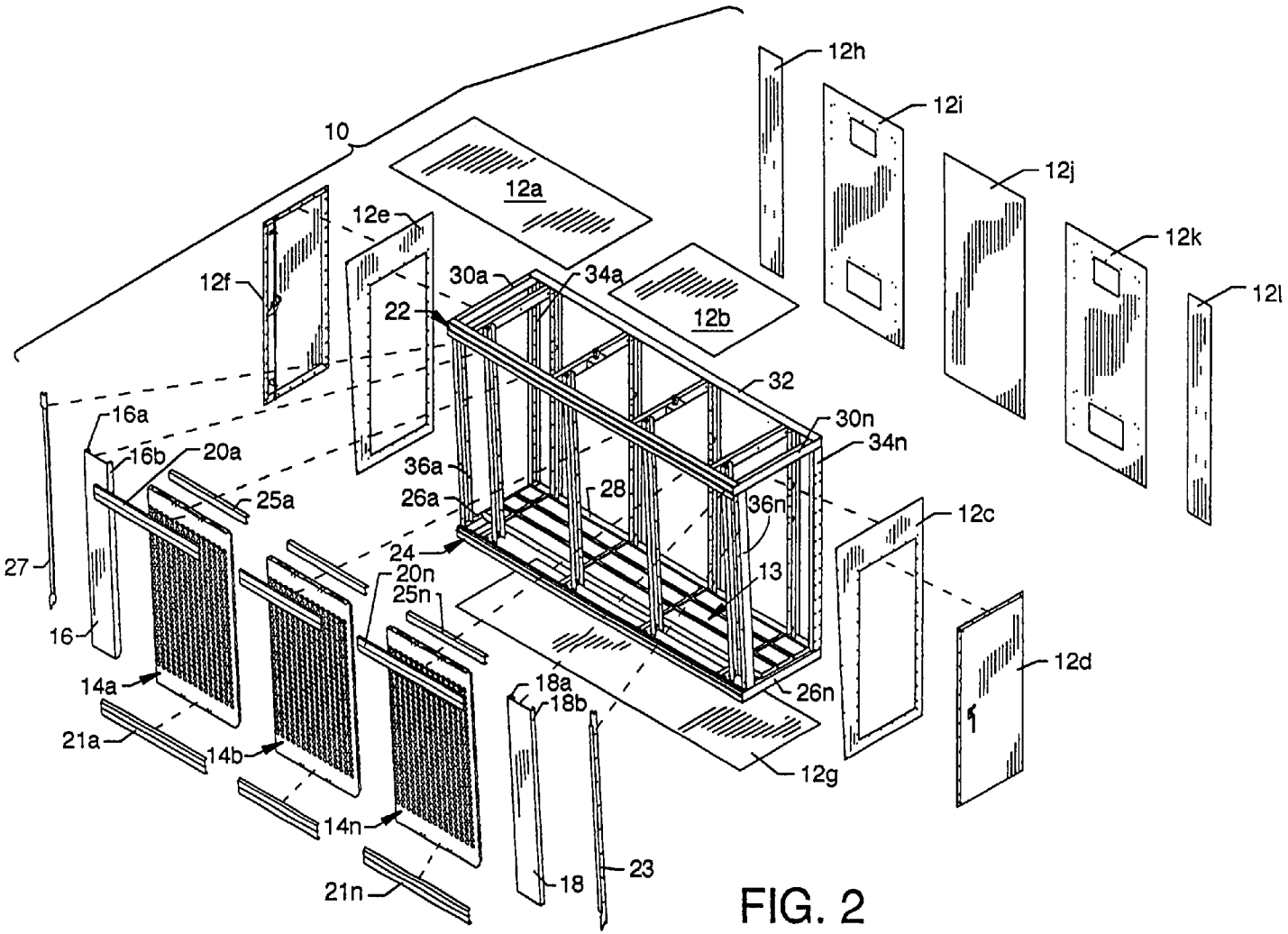
FIG. 2 is a partially exploded isometric view of the sign system where multiple principal and other components are shown distanced from the general support structure.

FIG. 1 is an isometric view of a sign system 10, the present invention. Readily observed components include an enclosure cabinet 12 including top panels 12*a* and 12*b*, an end panel 12*c*, and an access door 12*d*. Another end panel 12*e*, another access door 12*f*, a bottom panel 12*g*, rear panels 12*h*-12*l*, and a walkway 13, each being a part of the enclosure cabinet 12, are shown in FIG. 2. The viewable portion of the sign system 10 also includes a plurality of electronic display panels 14*a*-14*n* located between face plates 16 and 18, which are also part of the cabinet enclosure 12. Face plates 16 and 18 include edge panels 16*a*, 16*b* and 18*a*, 18*b*, respectively, as shown in FIG. 2. A plurality of top shrouds 20*a*-20*n* and a plurality of bottom shrouds 21*a*-21*n*, each being elongated and similar in construction and function, are shown in vertical orientation extending horizontally between the upper and lower regions of the face plates 16 and 18 partially covering the upper regions and partially covering the lower regions of the electronic display panels 14*a*-14*n*, respectively. A corner panel 23 is also shown connecting the end panel 12*c* to the ends of the top shroud 20*n* and the bottom shroud 21*n*. Another corner panel 27 (FIG. 2) is also utilized at the opposing end of the cabinet enclosure 12 for a similar purpose.

FIG. 2 is a partially exploded isometric view of the sign system 10 where multiple principal components and other various components are shown distanced from the general support structure for mounting of or being closely associated with a plurality of electronic display panels 14*a*-14*n*. Such principal components include a top support channel 22 which is unique and geometrically configured and elongated and a bottom support channel 24 which is unique and geometrically configured and elongated. The bottom support channel 24 is offset inwardly with respect to the top support channel 22. The support channels can be extruded or otherwise suitably constructed. Other significant unique and geometrically configured elongated principal components include the top shrouds 20*a*-20*n*, the bottom shrouds 21*a*-21*n*, and a plurality of retainer bars 25*a*-25*n*.

Other complementary and mutually and suitably attached elongated components include a plurality of horizontally aligned bottom channels 26*a*-26*n* extending rearwardly from the bottom support channel 24 to a horizontally aligned bottom rear support angle 28, a plurality of horizontally aligned top channels 30*a*-30*n* extending rearwardly from the top support channel 22 to a horizontally aligned top rear support angle 32, a plurality of vertically aligned rear channels 34*a*-34*n* extending from junctions formed by the bottom channels 26*a*-26*n* and the bottom rear support angle 28 to junctions formed by the top channels 30*a*-30*n* and the top rear support angle 32, and a plurality of front channels 36*a*-36*n* being suitably attached to and inwardly and correspondingly offset from the outwardly facing ends of the top channels 30*a*-30*n* and from the outwardly facing ends of the bottom channels 26*a*-26*n* and extending at an angle therebetween. The support channels and support angles all can be extruded or otherwise suitably constructed. The internal walkway 13 incorporated for access is also shown.

Figure 3:
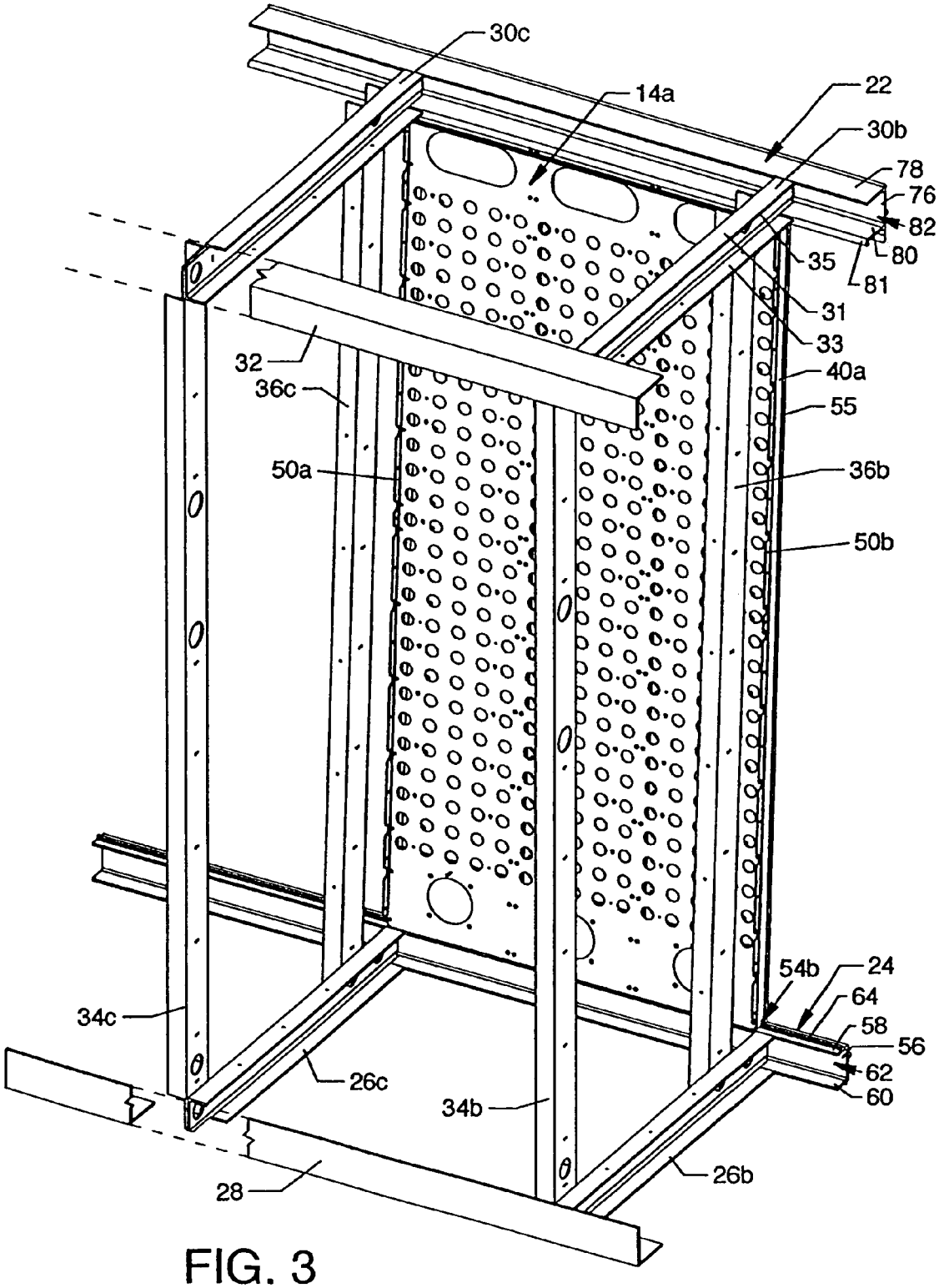
FIG. 3 is an isometric rear view of the general support structure of the sign system showing the relationship of the plurality of various channels and support angles to each other and to an electronic display panel.
Figure 12:
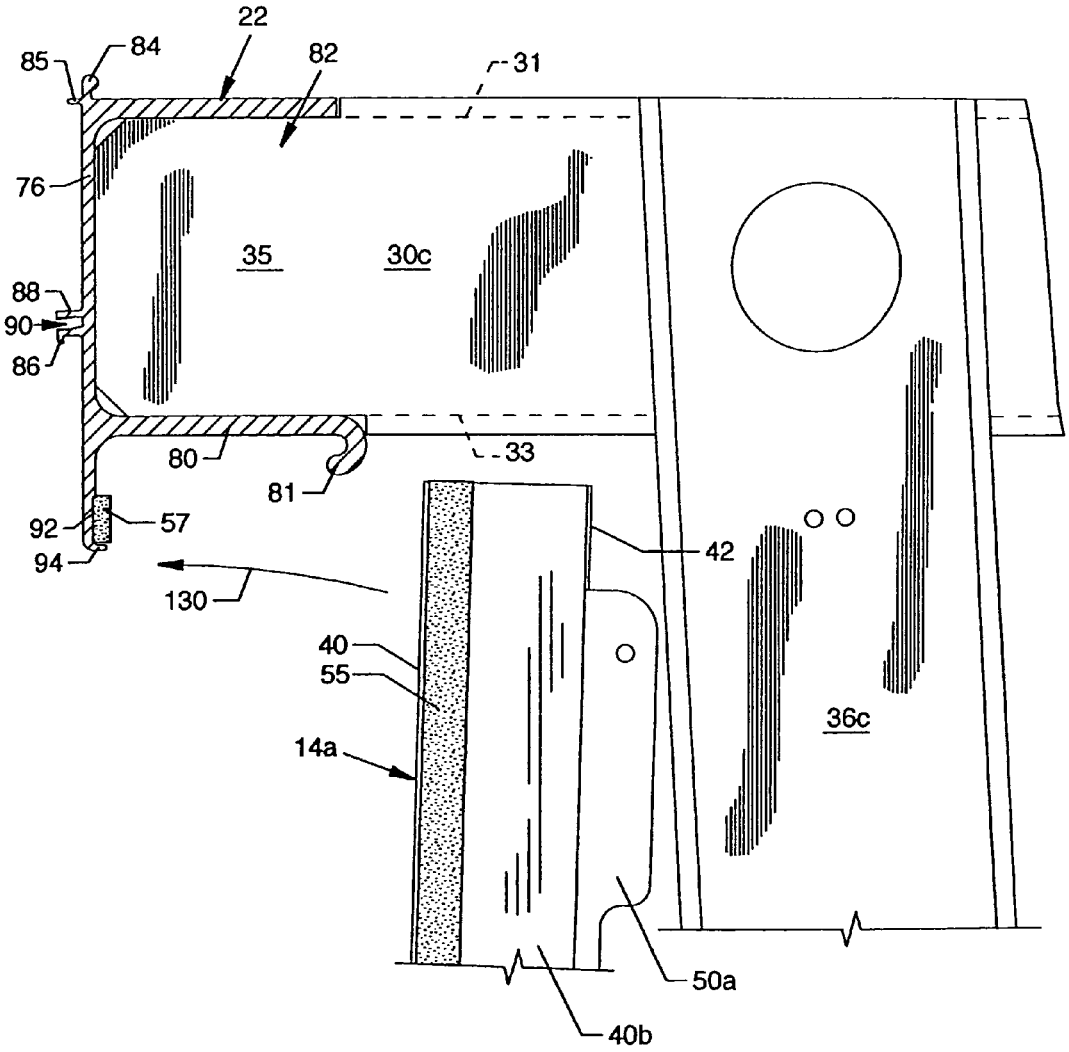
FIG. 12 shows the relationship of the top support channel to a top channel and to a front channel as well as to the upper region of an electronic display panel shown tilted rearwardly toward the front channel.

FIG. 3 is an isometric rear view of the general support structure of the sign system 10 showing the relationship of the plurality of various channels and support angles to each other and to the electronic display panel 14*a*. Portions of the top and bottom horizontal planar panels 31 and 33 at the forward ends of the top channels 30*a*-30*n* are removed, leaving just the vertical planar panel 35 which is accommodated by the open area 82 of the top support channel 22, as best shown in FIG. 12. The rearward ends of the top channels 30*a*-30*n* are configured much in the same manner, excluding removal of a portion of the bottom planar panel in order to facilitate accommodation by the top rear support angle 32. The bottom channels 26*a*-26*n* are similarly configured for accommodation by the bottom support channel 24 and the bottom rear support angle 28.

Figure 4:
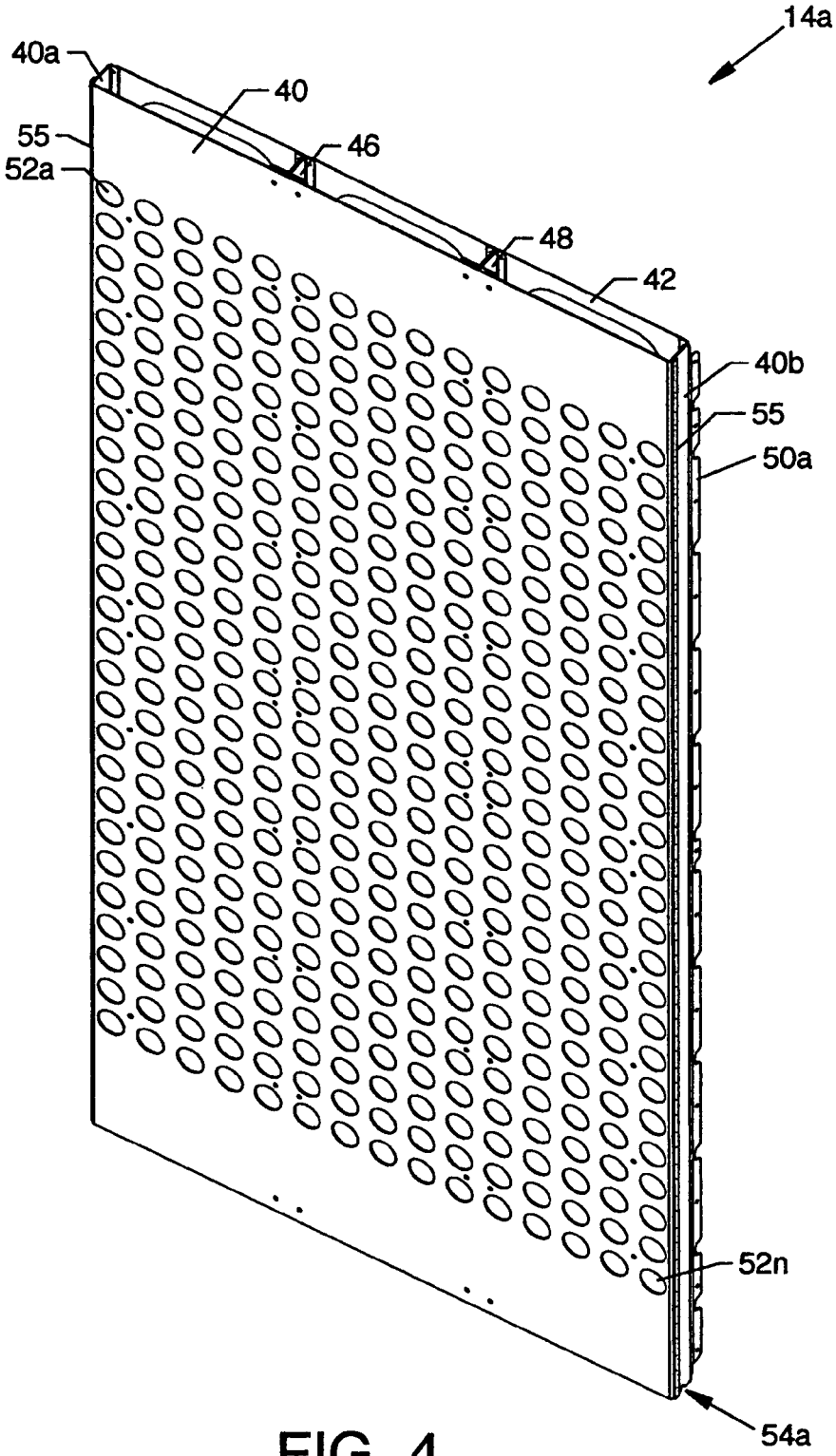
FIG. 4 is an isometric front view of an electronic display panel including a front panel and a connected rear panel.
Figure 15:
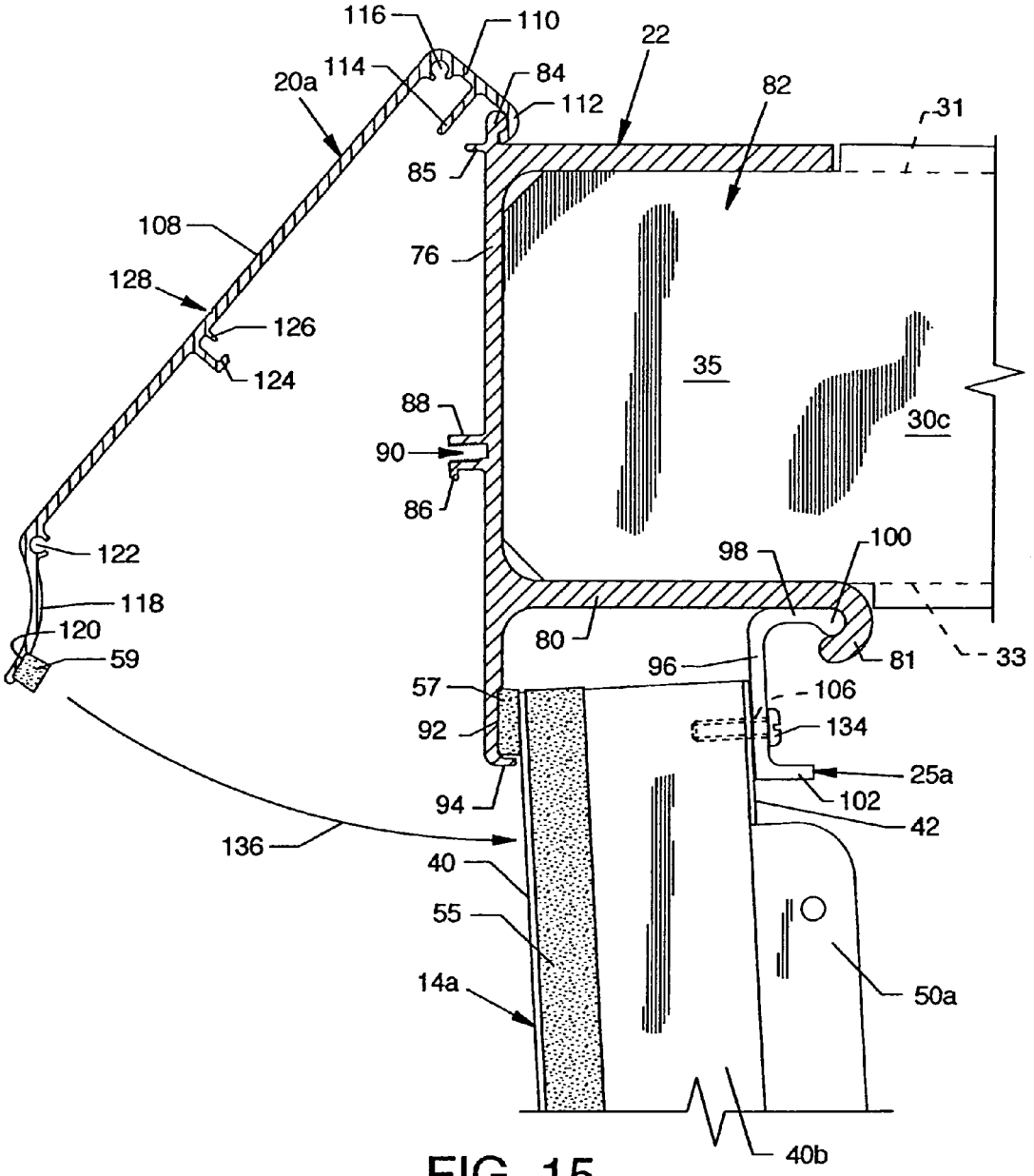
FIG. 15 is a view like FIG. 14 but showing the retainer bar in pressured intimate engagement with and secured by fasteners to the upper region of the electronic display panel and also showing a top shroud during the first stage of engagement with the top support channel.

FIG. 4 is an isometric front view of the electronic display panel 14*a*, including a front panel 40 and a connected rear panel 42. Edge panels 40*a* and 40*b* of the front panel 40 suitably secure to and provide spacing with the rear panel 42 in conjunction with vertically aligned spacer bracket assemblies 46 and 48, which provide both spacing and structural integrity. A series of apertured connection tabs 50*a* are formed integrally along one edge of the rear panel 42 and extend rearwardly therefrom at an angle, as shown. A corresponding series of apertured connection tabs 50*b* also are formed integrally along the opposed edge of the rear panel 42 and extend rearwardly therefrom at an angle, as shown in FIG. 3. The apertured connection tabs 50*a* and 50*b* on the rear panels 42 of adjacent electronic display panels 14*a*-14*n* are incorporated along with weatherstrip seals to mutually secure adjacent electronic display panels 14*a*-14*n*. A plurality of circular openings 52*a*-52*n* extending through the electronic display panels 14*a*-14*n* are included for viewing of an array (not shown) of light emitting diodes (LEDs) or other like devices. A notch 54*a* is included at the lower portion of the edge panel 40*b* and a corresponding notch 54*b* (FIG. 3) is included at the lower portion of the edge panel 40*a* for engagement with a pivot bar 64 of FIG. 6 to provide for support and mounting of the electronic display panels 14*a*-14*n*, as later described in detail. Flexible and pliable weatherstrip seals are incorporated in the design of the invention. One or more weatherstrip seals, such as a vertically oriented weatherstrip seal 55, can be used on one or more of the edge panels 40*a* and 40*b* of the front panels 40 to mutually seal the edge panels 40*a* and 40*b* of adjacent electronic display panels 14*a*-14*n* to each other or to seal between an outer edge panel 40*a* or 40*b* of an outer electronic display panel 14*a* or 14*n* and the edge panel 16*b* or 18*a*, respectively, of an adjacent face plate 16 or 18. A weatherstrip seal 57 is used in conjunction with the top support channel 22, as shown in FIG. 12, and a weatherstrip seal 59 is used with the top shrouds 20*a*-20*n*, as shown in FIG. 15.

Figure 5:
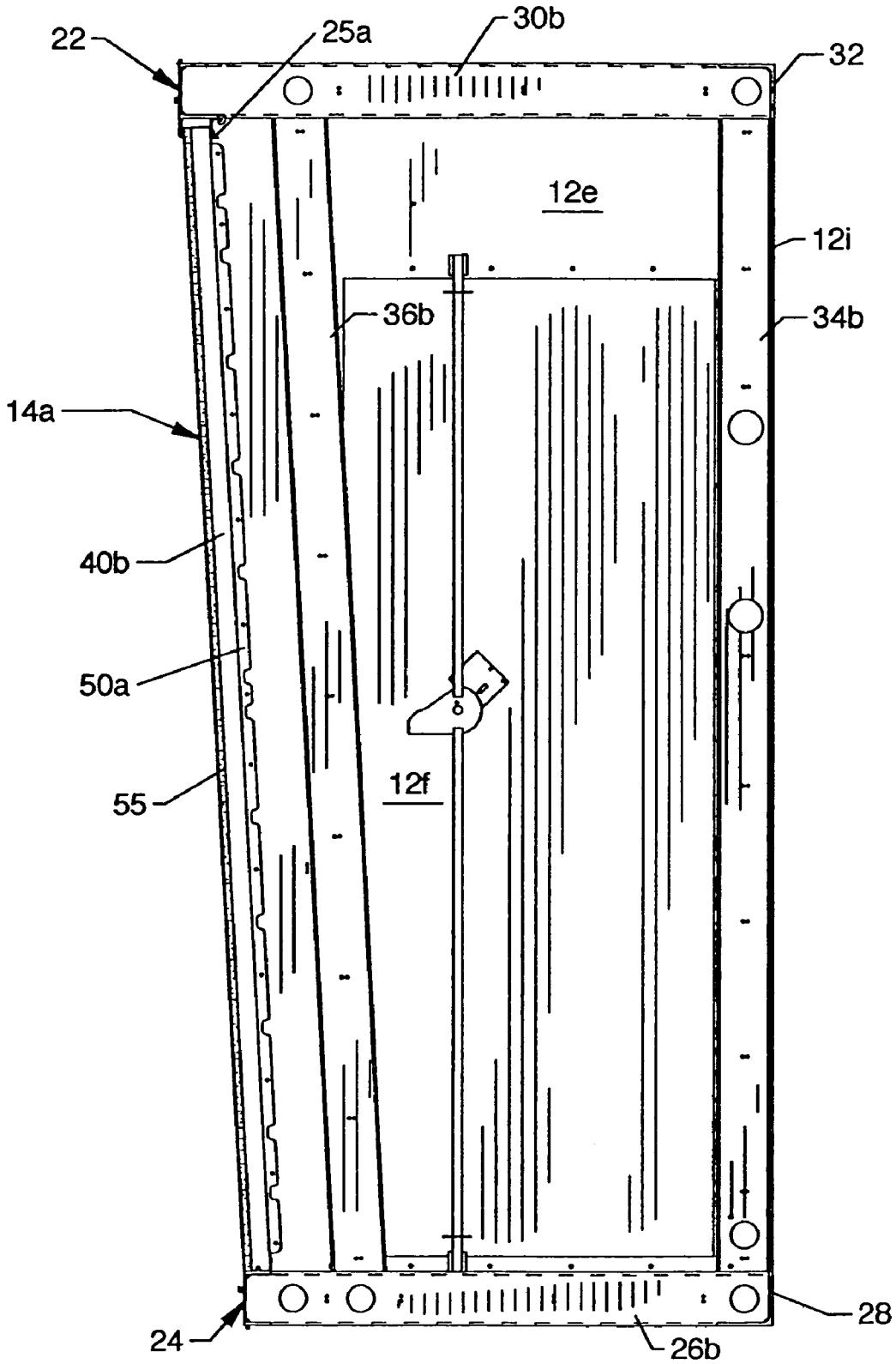
FIG. 5 is a cross section view of the sign system along line 5-5 of FIG. 1 showing an electronic display panel secured in operating position between the bottom support channel and the top support channel.

FIG. 5 is a cross section view of the sign system 10 along line 5-5 of FIG. 1 showing the electronic display panel 14*a* secured in operating position between the bottom support channel 24 and the top support channel 22.

Figure 6:
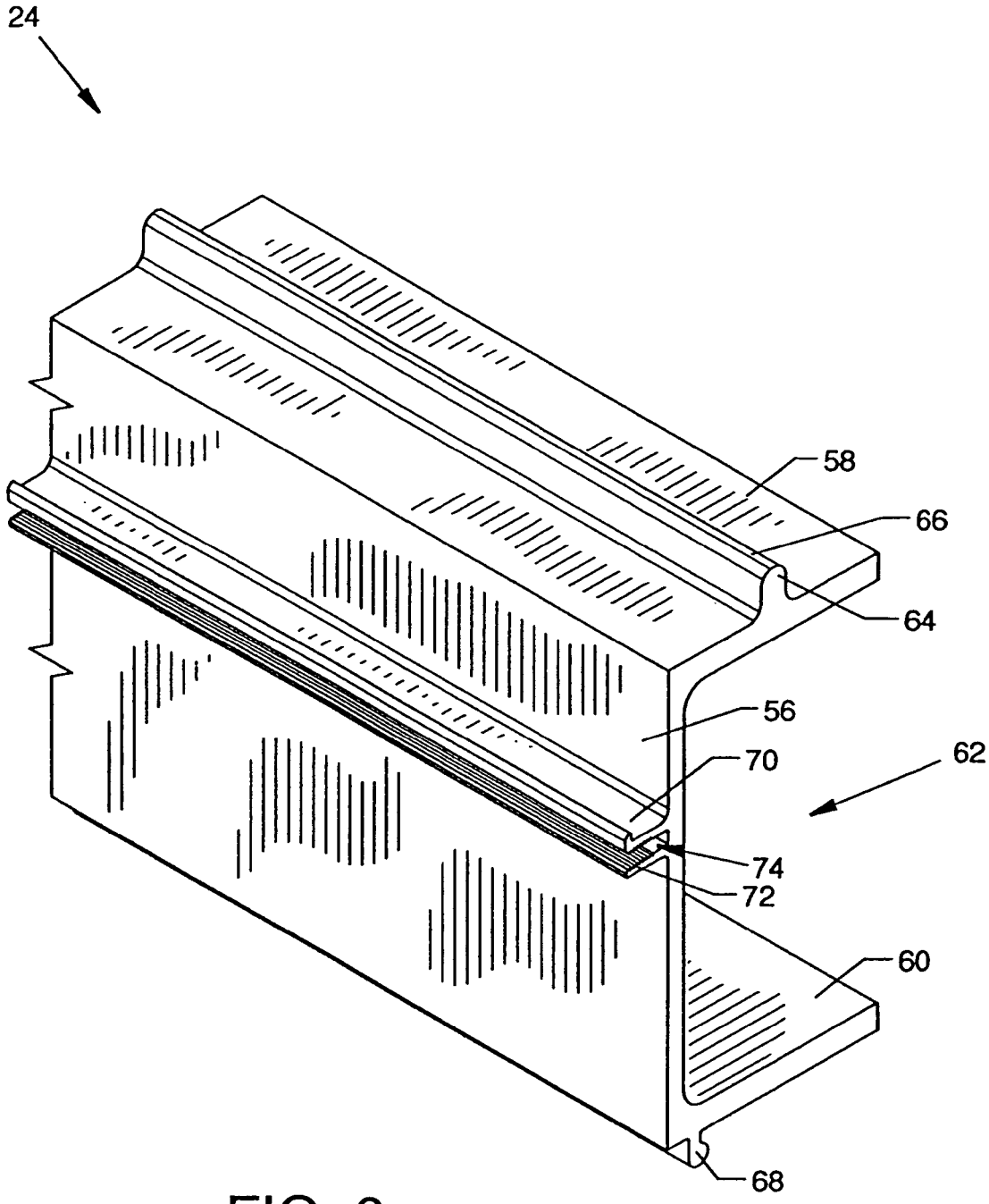
FIG. 6 is an isometric view showing a section of a bottom support channel.

FIG. 6 is an isometric view showing a section of the bottom support channel 24. Bottom support channel 24 is elongated and includes a vertically aligned front panel 56, a horizontally aligned top panel 58 extending preferably at a right angle from the front panel 56, a horizontally aligned bottom panel 60 extending preferably at a right angle from the front panel 56, an open area 62 between the top panel 58, the front panel 56 and the bottom panel 60, the pivot bar 64 having an upper arcuate surface 66, the pivot bar 64 extending in horizontal alignment along the outer surface of the top panel 58, an arcuate lip 68 extending in horizontal alignment along the outer surface of the bottom panel 60 in close proximity to the junction of the front panel 56 and the bottom panel 60, a catch panel 70 extending outwardly in horizontal alignment along the outer surface of the front panel 56, a panel 72 also extending outwardly in horizontal alignment along the outer surface of the front panel 56, and a multiply grooved slot 74 formed by structure of the catch panel 70 and the panel 72 extending along the catch panel 70 and the panel 72. The pivot bar 64, the catch panel 70, the panel 72, the multiply grooved slot 74, and the arcuate lip 68 all are elongated and extend along the length of the bottom support channel 24.

Figure 7:
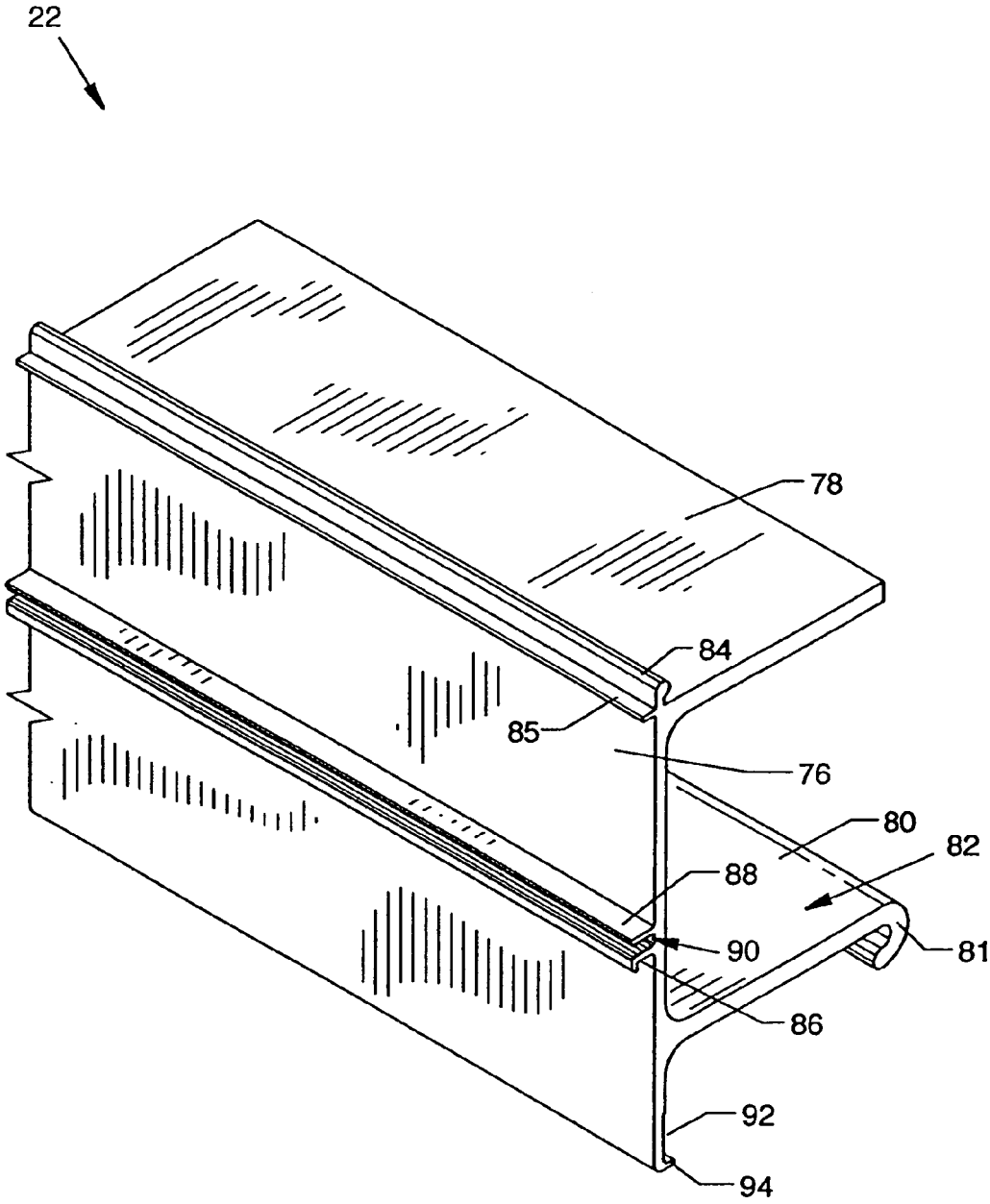
FIG. 7 is an isometric view showing a section of a top support channel.

FIG. 7 is an isometric view showing a section of the top support channel 22. Top support channel 22 is elongated and includes a vertically aligned front panel 76, a horizontally aligned top panel 78 extending preferably at a right angle from the front panel 76, a horizontally aligned bottom panel 80 extending preferably at a right angle from a lower region of the front panel 76, an elongated arcuate receptor 81 comprising the rear edge of the bottom panel 80 extending in horizontal alignment along the rear of the bottom panel 80, an open area 82 between the top panel 78, the front panel 76, and the bottom panel 80, an arcuate lip 84 extending in horizontal alignment along the outer surface of the top panel 78 in close proximity to the junction of the front panel 76 and the top panel 78, and a stop panel 85 extending in horizontal alignment along the outer surface of the front panel 76 in close proximity to the junction of the front panel 76 and the top panel 78 and in close proximity to the arcuate lip 84. A catch panel 86 extending outwardly in horizontal alignment along the outer surface of the front panel 76 and a panel 88 also extending outwardly in horizontal alignment along the outer surface of the front panel 76 form a multiply grooved slot 90 incorporating the structure of the catch panel 86 and the panel 88 extending along the catch panel 86 and the panel 88. An inwardly facing weatherstrip channel 92 abuts a lip 94, each extending along the lower portion of the front panel 76. The arcuate lip 84, the stop panel 85, the panel 88, the catch panel 86, the multiply grooved slot 90, the weatherstrip channel 92, and the lip 94 all are elongated and extend along the length of the top support channel 22.

Figure 8:
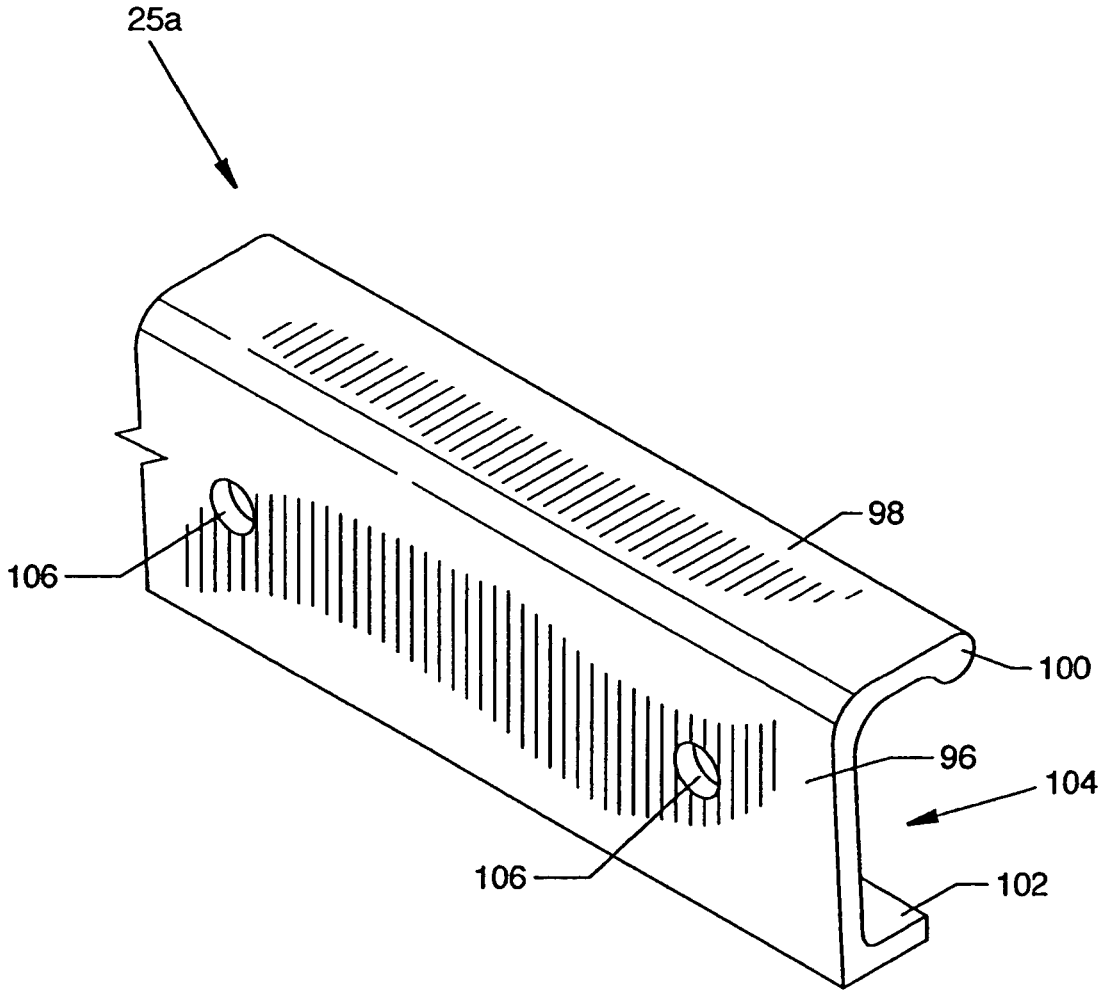
FIG. 8 is an isometric view showing a section of a retainer bar.

FIG. 8 is an isometric view showing a section of retainer bar 25*a*. Retainer bar 25*a* is elongated and includes a vertically aligned front panel 96, a horizontally aligned top panel 98 extending preferably at a right angle from the front panel 96, an elongated arcuate lip 100 comprising the rear edge of the top panel 98 extending in horizontal alignment along the rear of the top panel 98, a horizontally aligned bottom panel 102 extending preferably at a right angle from the front panel 96, an open area 104 between the top panel 98, the front panel 96, and the bottom panel 102, and a plurality of holes 106 extending through the front panel 96. The retainer bars 25*a*-25*n* can be extruded or otherwise suitably constructed.

Figure 9:
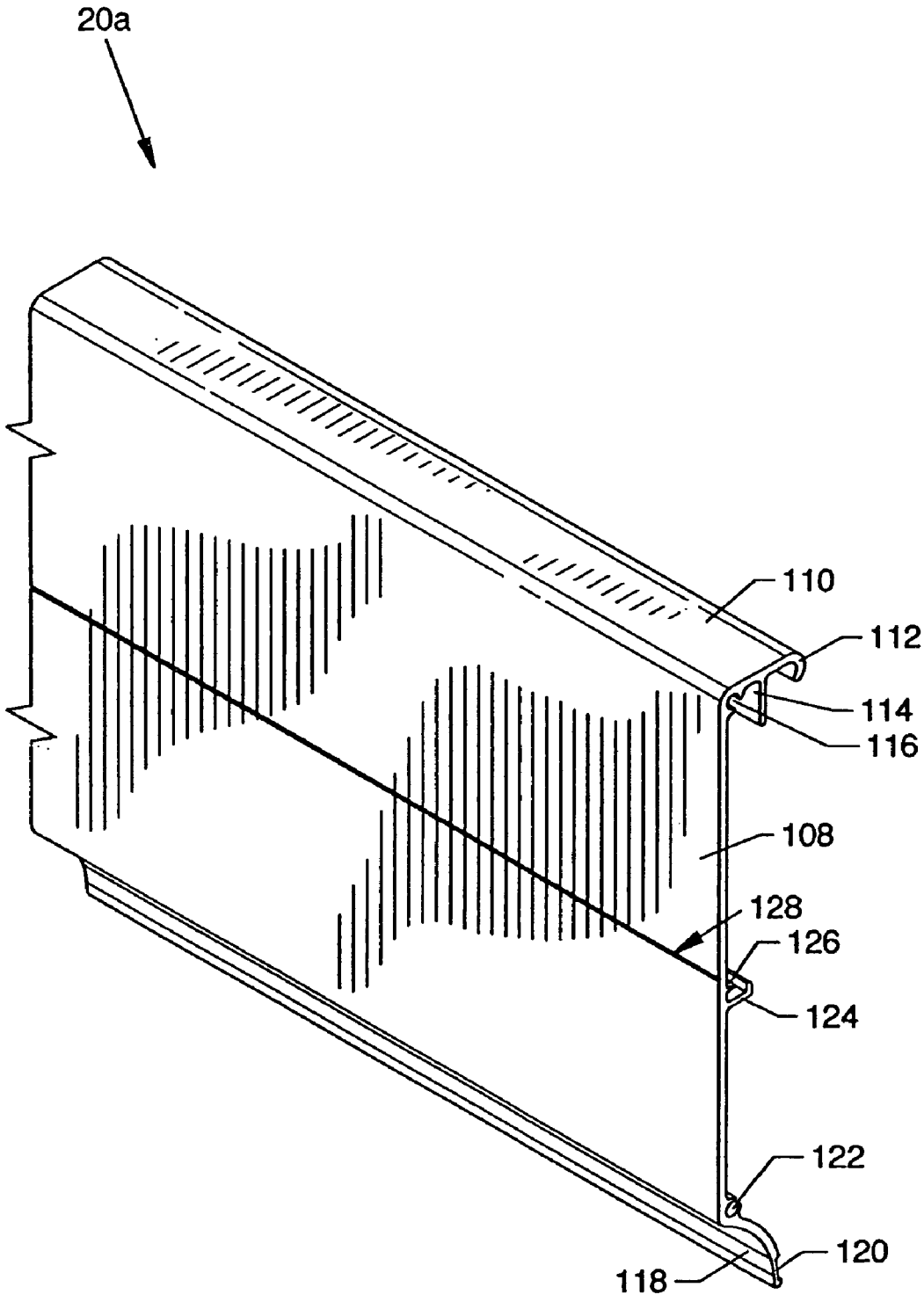
FIG. 9 is an isometric view showing a section of a top shroud.
Figure 10:
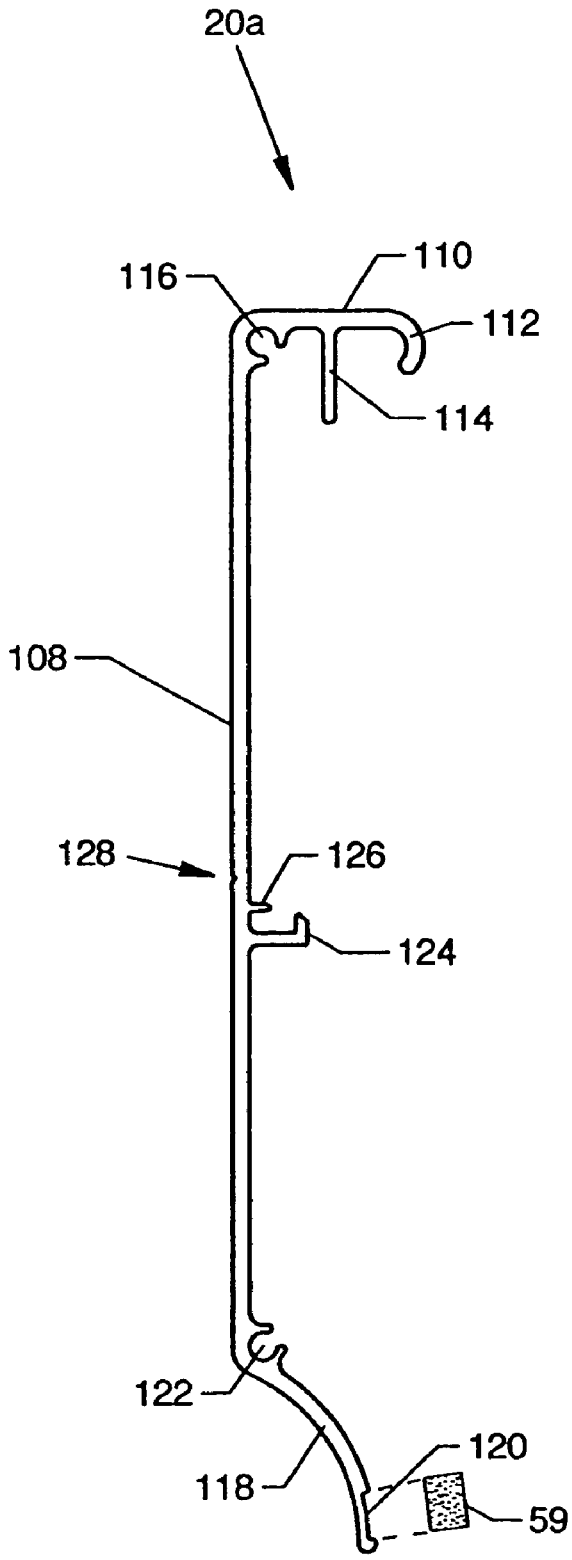
FIG. 10 is an end view of the top shroud shown in FIG. 9.

FIG. 9 is an isometric view showing a section of the top shroud 20*a*, and FIG. 10 is an end view of the top shroud 20*a*. The features of the top shroud 20*a*, which is elongated, are described herein with reference to FIGS. 9 and 10. Top shrouds 20*a*-20*n* and bottom shrouds 21*a*-21*n* are similar in shape and function. The top shroud 20*a* includes a vertically aligned front panel 108, a horizontally aligned connecting panel 110 extending preferably and substantially at a right angle from the front panel 108, an arcuate receptor 112 comprising the rear edge of the connecting panel 110 extending in horizontal alignment along the rear of the connecting panel 110, a stop panel 114 extending downwardly from the inner surface of the connecting panel 110 and extending in horizontal alignment along the underside of the connecting panel 110, and an inwardly open arcuate groove 116 which can accommodate self-tapping screws at the junction of the front panel 108 and the connecting panel 110 extending along the upper region of the top shroud 20*a*. The top shroud 20*a* also includes an arcuate panel 118 extending inwardly from the lower region of the front panel 108 extending in horizontal alignment along the lower region of the top shroud 20*a*, an inwardly facing weatherstrip channel 120 at the lower region of the arcuate panel 118 extending along the lower portion of the arcuate panel 118, and an inwardly open arcuate groove 122 which can accommodate self-tapping screws at the junction of the front panel 108 and the arcuate panel 118 and extending along the top shroud 20*a*. The mid-section of the front panel 108 includes a catch panel 124 extending inwardly in horizontal alignment along the inner surface of the front panel 108, and a stop panel 126 extending inwardly in horizontal alignment along the inner surface of the front panel 108. A score 128 is located on the outer surface of the front panel 108 in suitable offset alignment with the stop panel 126. The arcuate receptor 112, the stop panel 114, the arcuate groove 116, the catch panel 124, the stop panel 126, the arcuate groove 122 and the weatherstrip channel 120 all are elongated and extend along the length of the top shroud 20*a*. The mirror image bottom shroud 21*a* includes the same features as the top shroud 20*a*. The top shrouds 20*a*-20*n* and the bottom shrouds 21*a*-21*n* can be extruded or otherwise suitably constructed.

Mode of Operation

FIGS. 11, 12, 13, 14, 15 and 16 illustrate the mode of operation of the sign system 10, showing the installation of the electronic display panel 14*a* in the framework structure at the front of the enclosure cabinet 12. The same method is used for installation of the electronic display panels 14*b*-14*n*. The electronic display panels 14*a*-14*n* are generally installed during a single installation sequence, but may be installed individually.

Figure 11:
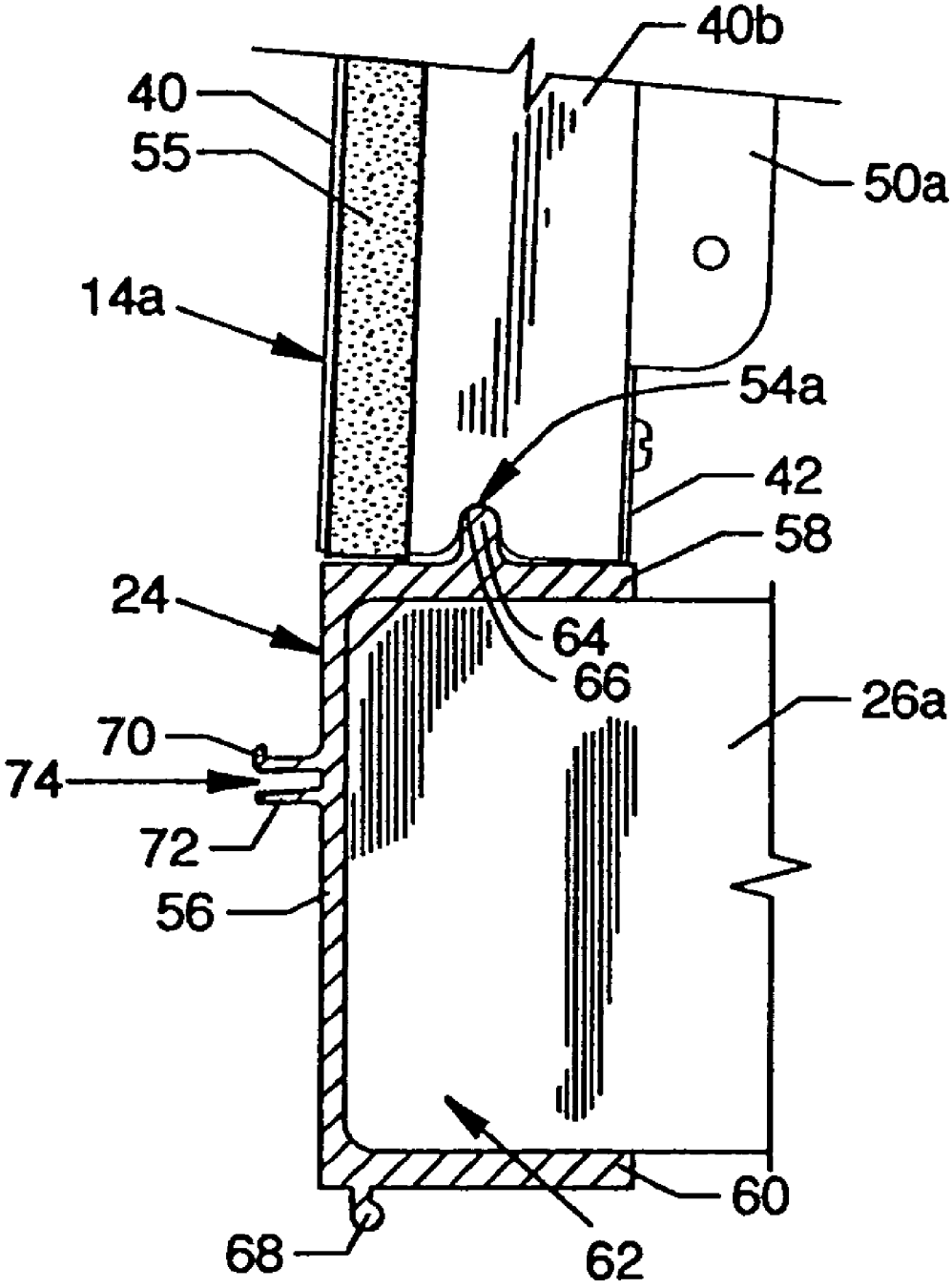
FIG. 11 shows the relationship of the bottom support channel to an electronic display panel.

FIG. 11 shows the relationship of the bottom support channel 24 to the electronic display panel 14*a*. The electronic display panel 14*a* can include a weatherstrip seal 55 on the edge panel 40*a* (FIG. 4) to seal against the edge panel 16*b* of the face plate 16 (FIG. 2) and another weatherstrip seal 55 on the edge panel 40*b* to seal against the edge panel 40*a* of the electronic display panel 14*b*. Any suitable arrangement of weatherstrip seals 55 can be utilized at the edge panels 40*a* and 40*b* of the electronic display panels 14*a*-14*n* to effect suitable seals along the adjacent vertical edges, such as, but not limited to, the juxtaposed edge panels 40*a* and 40*b* of the electronic display panels 14*a*-14*n*, as well as with the edge panel 16*b* of the face plate 16 and the edge panel 18*a* of the face plate 18. The electronic display panel 14*a* is maneuvered to place the notches 54*a* and 54*b* at the lower region of each edge panel 40*a* and 40*b* of the electronic display panel 14*a* into intimate and accommodational captured support with the arcuate surface 66 of the pivot bar 64 and then urged toward the edge panel 16*b* of the face plate 16 to seal thereagainst utilizing a weatherstrip seal 55 located on the edge panel 40*a* of the electronic display panel 14*a*. During installation, the top of the electronic display panel 14*a* can be tilted rearwardly toward the vertically oriented front channel 36*c*, such as indicated in FIGS. 11 and 12, but could be tilted forwardly toward the lower region of the front panel 76 of the top support channel 22, such as shown in FIG. 13.

FIG. 12 shows the relationship of the top support channel 22 to the top channel 30*c* and to the front channel 36*c*, as well as to the upper region of the electronic display panel 14*a*, which is shown tilted rearwardly toward the vertically oriented front channel 36*c*. During installation, the upper region of the electronic display panel 14*a* is pivoted outwardly about the pivot bar 64 of the bottom support channel 24 in a direction as shown by arrow 130. Such pivotal action takes place about the points of commonality of the pivot bar 64 and the notches 54*a* and 54*b* (FIG. 11) to cause the top of the electronic display panel 14*a* to impinge the horizontally oriented weatherstrip seal 57 which is secured and located in the horizontally oriented weatherstrip channel 92 at the lower region of the top support channel front panel 76. Such impingement is shown in FIG. 13 and is part of an automatic sealing feature which is described further with reference to FIG. 15.

Figure 13:
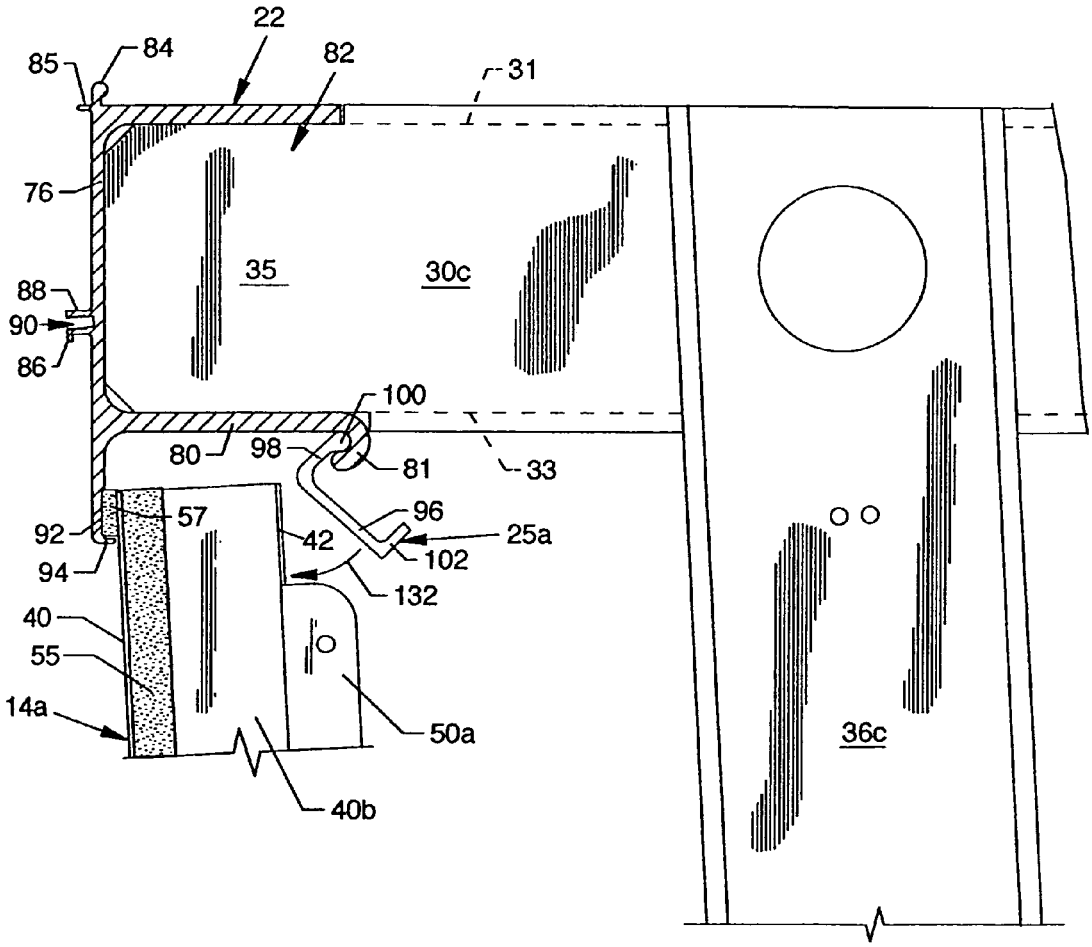
FIG. 13 shows the relationship of the top support channel to a top channel and to a front channel, and also shows an electronic display panel impinging the top support channel, and a retainer bar in a first stage of engagement with the top support channel.

FIG. 13 shows the relationship of the top support channel 22 to the top channel 30*c* and to the front channel 36*c*, and also shows an electronic display panel 14*a* impinging the top support channel 22, and the retainer bar 25*a*, which is shown in the first stage of engagement with the top support channel 22. More precisely, the arcuate lip 100 is shown in intimate contact with the arcuate receptor 81 at the end of the top support channel bottom panel 80 awaiting pivotal positioning along the arcuate receptor 81 as indicated by arrow 132.

Figure 14:
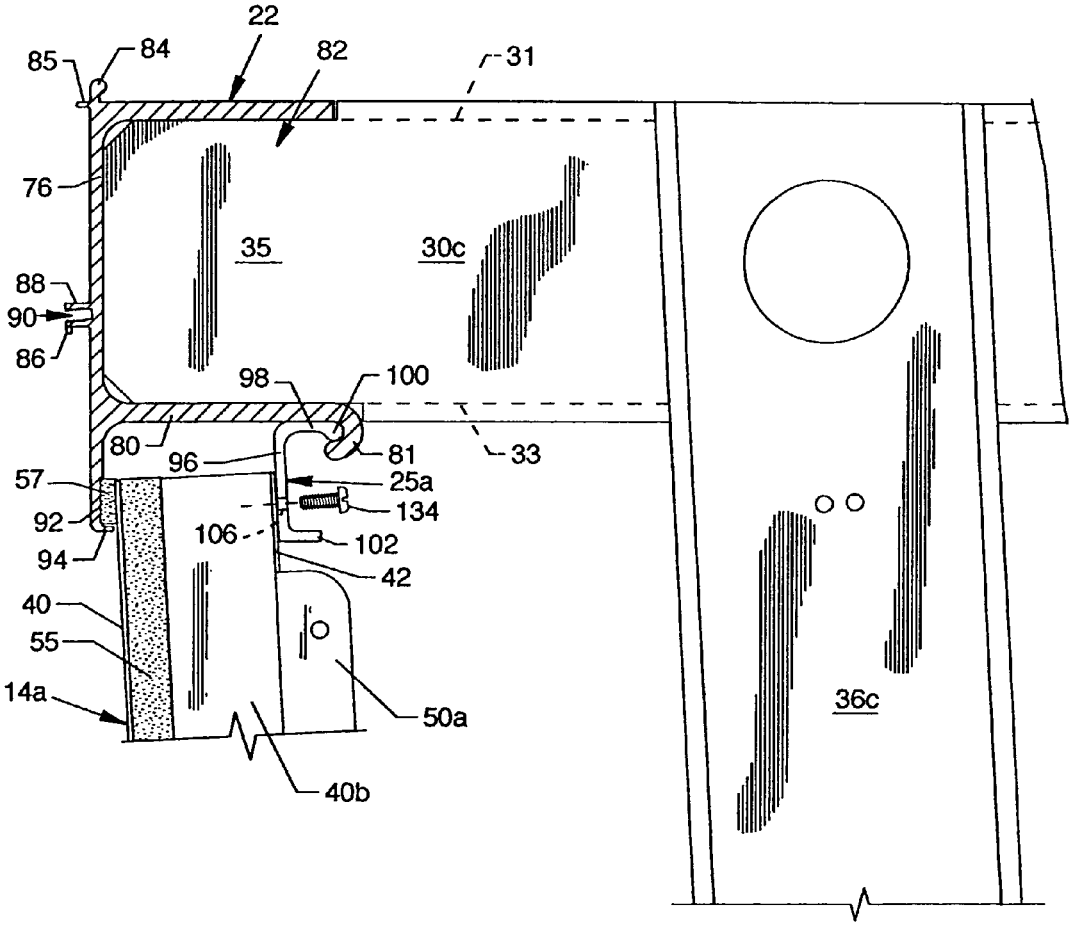
FIG. 14 is a view like FIG. 13 but showing the retainer bar in intimate contact between the top support channel and the upper region of the electronic display panel.

FIG. 14 shows the arcuate lip 100 of the retainer bar 25*a* in intimate contact with the arcuate receptor 81 located at the end of the top support channel bottom panel 80 where the retainer bar 25*a* has been pivotally positioned along the arcuate receptor 81 to cause the top panel 98 of the retainer bar 25*a* to be stoppingly engaged by the bottom panel 80 of the top support channel 22. The top panel 98 is of sufficient length such that pivotal positioning of the retainer bar 25*a* forcibly urges the front panel 96 of the retainer bar 25*a* into pressured intimate engagement with the upper region of the electronic display panel 14*a* at the upper region of the rear panel 42. Such pressured intimate engagement resultantly causes the upper region of the front panel 40 of the electronic display panel 14*a* to forcibly and sealingly engage the weatherstrip seal 57 located in the weatherstrip channel 92 at the lower region of the top support channel front panel 76 as a part of the automatic sealing feature. A plurality of fasteners 134 which preferably could be machine screws or other suitable fasteners, pass through the plurality of holes 106 to firmly and threadingly or otherwise engage the rear panel 42 to secure and affix the retainer bar 25*a* to the rear panel 42 and thus effect captured support of the upper region of the electronic display panel 14*a*.

FIG. 15 shows the retainer bar 25*a* in pressured intimate engagement with and secured by the fasteners 134 to the upper region of the electronic display panel 14*a* at the upper region of the rear panel 42 as part of the automatic sealing feature. Also shown is the top shroud 20*a* during the first stage of engagement with the top support channel 22. More precisely, the arcuate receptor 112 at the end of the connecting panel 110 is shown in intimate contact with the arcuate lip 84 of the top support channel 22 awaiting pivotal positioning along the elongated arcuate lip 84 as indicated by arrow 136.

Figure 16:
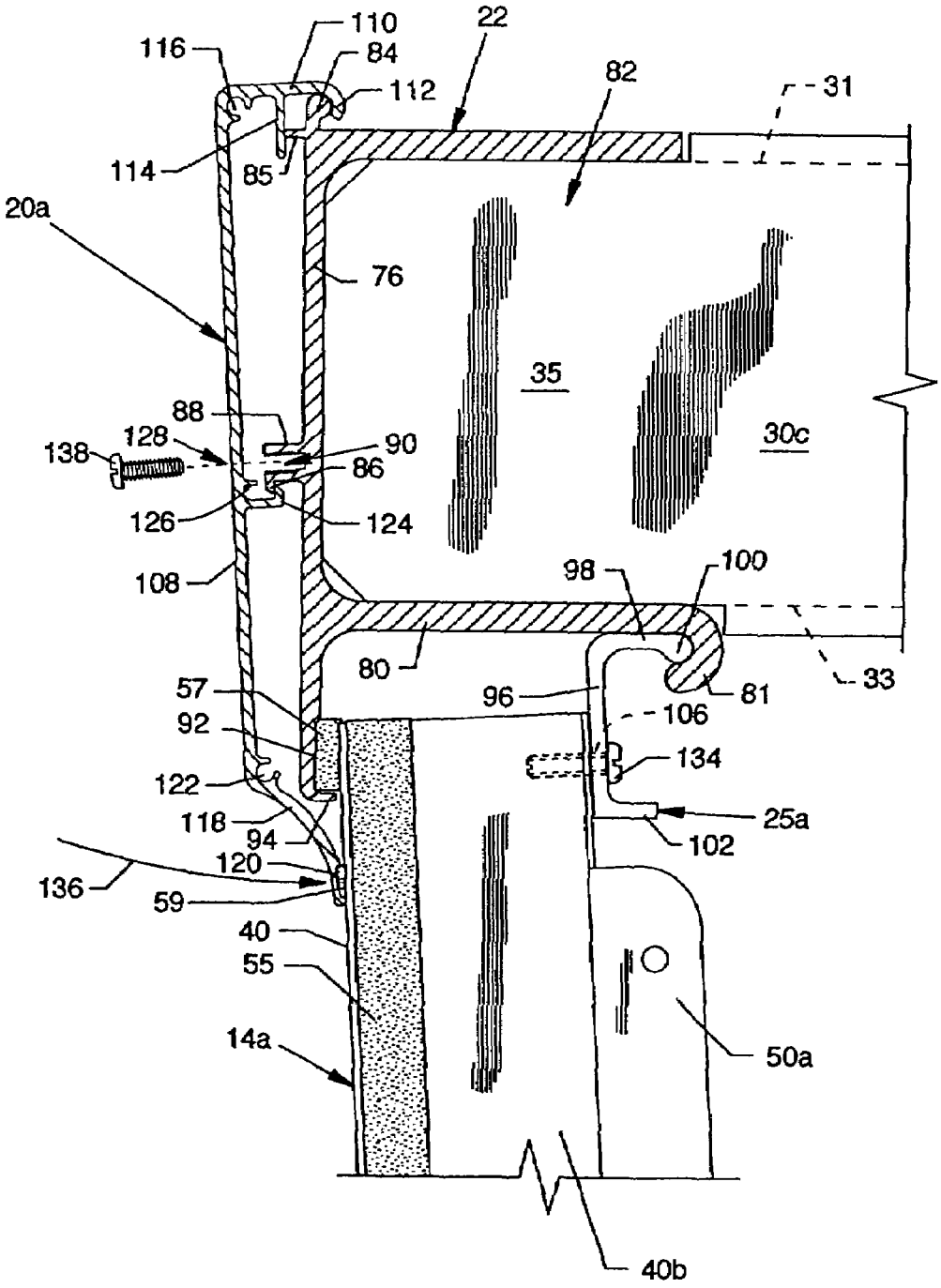
FIG. 16 is a view like FIG. 15 but showing the top shroud in full engagement with the top support channel and in sealed contact with the upper region of the electronic display panel; and, FIG. 17 shows a bottom shroud, a mirror image likeness of the top shroud, in full engagement with the bottom support channel and in sealed contact with the lower region of the electronic display panel.

FIG. 16 shows the top shroud 20*a* in full engagement with the top support channel 22 and in sealed contact with the upper region of the electronic display panel 14*a*. The top shroud 20*a* is shown pivoted about the arcuate lip 84 of the top support channel 22, as shown by arrow 136.

The top shroud 20*a* is pivoted about the arcuate lip 84 to cause several simultaneous or near simultaneous events. In one event, the catch panel 124 of the top shroud 20*a* impinges and engages the catch panel 86 of the top support channel 22 as the front panel 108 is flexed to automatically maintain the position of the top shroud 20*a* in close relationship and proximity to and about the front panel 76 of the top support channel 22. Another event is the forced positioning of the weatherstrip seal 59 to automatically seal against the upper region of the electronic display panel 14*a* at the front panel 40. Another event is the alignment of the stop panel 114 of the top shroud 20*a* against the stop panel 85 of the top support channel 22 to assist in pivotal limiting of the top shroud 20*a*.

Although the top shroud 20*a* is secured to the top support channel 22 and effects a seal along the upper region of the electronic display panel 14*a*, as just described, alternative and additional fixation can also be utilized. A plurality of fasteners 138, which preferably could be machine screws, can utilize body holes subsequently drilled along the score 128 of the front panel 108 to engage the multiply grooved slot 90 extending from the front panel 76 of the top support channel 22 to robustly complement the previously described automatic attachment method. The stop panel 126 is available to limit concave flexing of the front panel 108 by overtightening of the fasteners 138. Such limiting is effected by the contacting of the stop panel 126 with an edge of the catch panel 86 extending from the front panel 76 of the top support channel 22. Additionally, the arcuate groove 116 at the junction of the front panel 108 and the connecting panel 110 extending along the top shroud 20*a*, and the arcuate groove 122, which optionally can include screw threads, at the junction of the front panel 108 and the arcuate panel 118 and extending along the top shroud 20*a* can be incorporated for attachment and further securing of the corner panel 23 (and 27).

Figure 17:
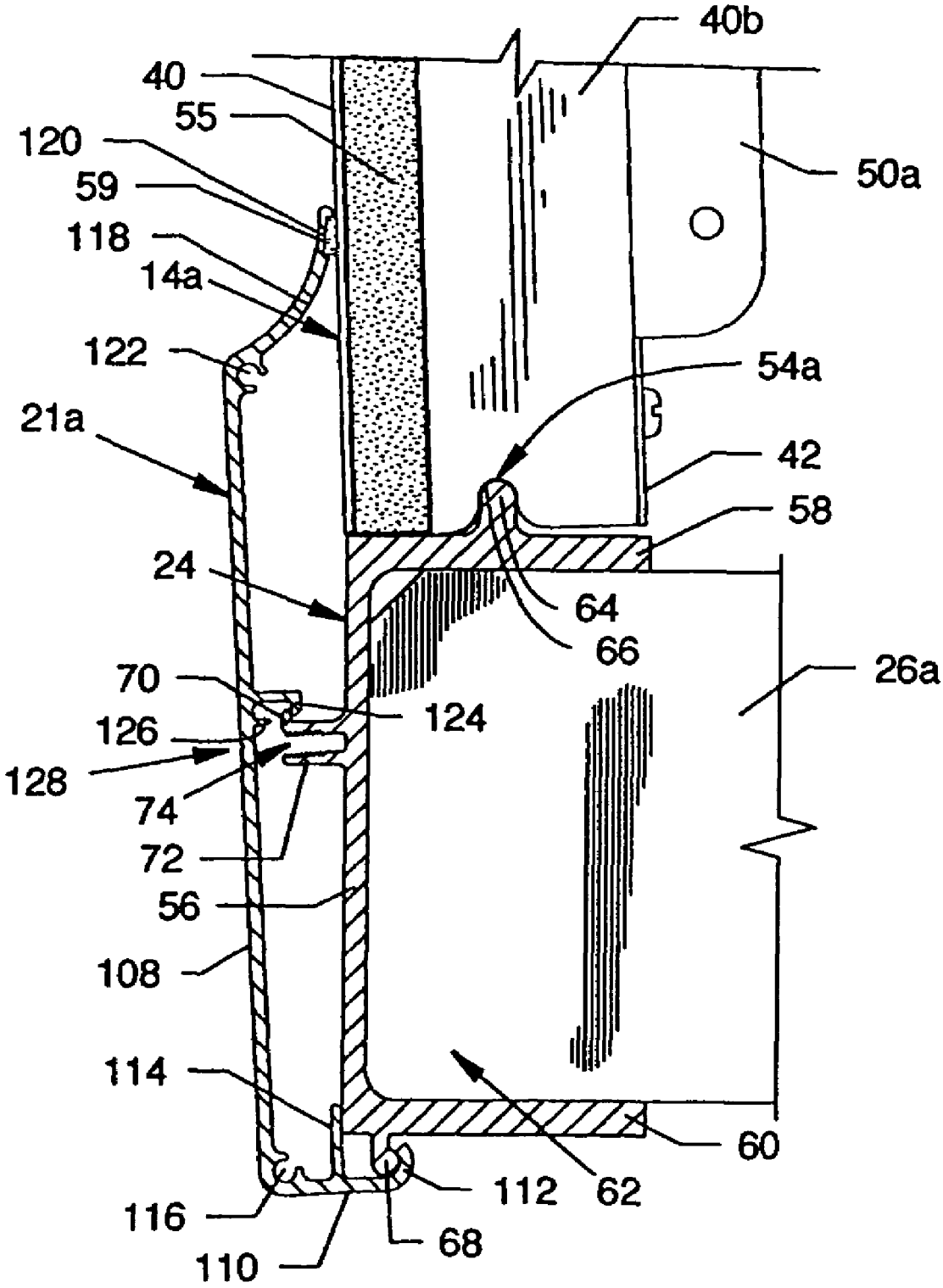

FIG. 17 shows the bottom shroud 21*a*, a mirror image likeness of the top shroud 20*a*, in full engagement with the bottom support channel 24 and in sealed contact with the lower region of the electronic display panel 14*a* in a manner closely associated with the engagement and sealing of the top shroud 20*a* to the top support channel 22 and upper region of the electronic display panel 14*a*, respectively. In this view, the stop panel 114 engages the lower portion of the bottom support channel 24 at the front panel 56.

The sign system 10 provides a sign system which is versatile for purposes of construction and for purposes of changeout. Individual electronic display panels 14*a*-14*n* can be readily removed and replaced from the interior of the enclosure cabinet 12. Replacement is simple and may be accomplished by the removal of any required fasteners utilized between the apertured connection tabs 50*a* and 50*b* of adjoining electronic display panels utilized, followed by removal of the fasteners 134 from one or more of the retainer bars 25*a*-25*n* utilized to secure the upper region of one or more electronic display panels 14*a*-14*n* to thence remove one or more retainer bars 25*a*-25*n*. The top of one or more of the electronic display panels 14*a*-14*n* is then pivoted rearwardly to cause pivoting of one or more of the electronic display panels 14*a*-14*n* about the pivot bar 64. One or more of the electronic display panels 14*a*-14*n* are then lifted from contact with the pivot bar 64 and repaired or replaced. Installation takes place in reverse step order. Removal of the top and bottom shrouds 20*a* and 21*a* is not required.

Various modifications can be made to the present invention without departing from the apparent scope hereof.

SIGN SYSTEM
PARTS LIST

| | |
|---|---|
| 10 | sign system |
| 12 | enclosure cabinet |
| 12a | top panel |
| 12b | top panel |
| 12c | end panel |
| 12d | access door |
| 12e | end panel |
| 12f | access door |
| 12g | bottom panel |
| 12h-l | rear panels |
| 13 | walkway |
| 14a-n | electronic display panels |
| 16 | face plate |
| 16a-b | edge panels |
| 18 | face plate |
| 18a-b | edge panels |
| 20a-n | top shrouds |
| 21a-n | bottom shrouds |
| 22 | top support channel |
| 23 | corner panel |
| 24 | bottom support channel |
| 25a-n | retainer bars |
| 26a-n | bottom channels |
| 27 | corner panel |
| 28 | bottom rear support angle |
| 30a-n | top channels |
| 31 | top planar panel |
| 32 | top rear support angle |
| 33 | bottom planar panel |
| 34a-n | rear channels |
| 35 | planar panel |
| 36a-n | front channels |
| 40 | front panel |
| 40a-b | edge panels |
| 42 | rear panel |
| 46 | spacer bracket assembly |
| 48 | spacer bracket assembly |
| 50a-b | apertured connection tabs |
| 52a-n | circular openings |
| 54a-b | notches |
| 55 | weatherstrip seal |
| 56 | front panel |
| 57 | weatherstrip seal |
| 58 | top panel |
| 59 | weatherstrip seal |
| 60 | bottom panel |
| 62 | open area |
| 64 | pivot bar |
| 66 | arcuate surface |

-continued

| SIGN SYSTEM PARTS LIST | |
|---|---|
| 68 | arcuate lip |
| 70 | catch panel |
| 72 | panel |
| 74 | multiply grooved slot |
| 76 | front panel |
| 78 | top panel |
| 80 | bottom panel |
| 81 | arcuate receptor |
| 82 | open area |
| 84 | arcuate lip |
| 85 | stop panel |
| 86 | catch panel |
| 88 | panel |
| 90 | multiply grooved slot |
| 92 | weatherstrip channel |
| 94 | lip |
| 96 | front panel |
| 98 | top panel |
| 100 | arcuate lip |
| 102 | bottom panel |
| 104 | open area |
| 106 | hole |
| 108 | front panel |
| 110 | connecting panel |
| 112 | arcuate receptor |
| 114 | stop panel |
| 116 | arcuate groove |
| 118 | arcuate panel |
| 120 | weatherstrip channel |
| 122 | arcuate groove |
| 124 | catch panel |
| 126 | stop panel |
| 128 | score |
| 130 | arrow |
| 132 | arrow |
| 134 | fastener |
| 136 | arrow |
| 138 | fastener |

The invention claimed is:

1. A sign system comprising:

a. a framework for support including unique geometrically configured top and bottom support channels which are elongated and connected to other framework components;

b. a plurality of juxtaposed electronic display panels where each electronic display panel rests on a pivot bar on the top panel of the unique geometrically configured bottom support channel and where the top regions of each electronic display panel engage a weatherstrip seal at the front panel of the top support channel and are positionally secured thereagainst by a retainer bar;

c. a plurality of weatherstrip seals located in vertical orientation along one or more edges of the electronic display panels, a plurality of top shrouds each being elongated and having an arcuate receptor extending along a connecting panel which engages an arcuate lip extending along the top support channel and having a weatherstrip seal located along an arcuate panel for contacting the upper region of electronic display panels;

d. a plurality of bottom shrouds each being elongated and having an arcuate receptor extending along a connecting panel which engages an arcuate lip extending along the bottom support channel and having a weatherstrip seal located along an arcuate panel thereof for contacting the lower regions of the electronic display panels; and, e. inwardly extending elongated catch panels extending along the front panels of each of the top and bottom shrouds which engage outwardly extending elongated catch panels extending along the front panels of the top and bottom support channels, respectively, to maintain the relationship of each top shroud with the top support channel and the electronic display panels and each bottom shroud with the bottom support channel and the electronic display panels.

* * * * *